US006224276B1

(12) United States Patent
Funayama et al.

(10) Patent No.: US 6,224,276 B1
(45) Date of Patent: May 1, 2001

(54) INK RIBBON CARTRIDGE INCLUDING INK RIBBON DAMAGING MEANS AND ROTATION DIRECTION RESTRICTING MEANS

(75) Inventors: Hidehiko Funayama; Takatoshi Iwanabe, both of Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/321,310

(22) Filed: May 27, 1999

(30) Foreign Application Priority Data

Jun. 5, 1998 (JP) ..... 10-157772

(51) Int. Cl.[7] ..... B41J 33/14

(52) U.S. Cl. ..... 400/227.1; 400/227; 400/207; 400/196

(58) Field of Search ..... 400/191, 194, 400/195, 196, 196.1, 207, 208.1, 227, 227.1, 247, 248

(56) References Cited

U.S. PATENT DOCUMENTS 4,504,015 3/1985 Meinhardt et al. .
4,688,954 8/1987 Hofmann .
4,926,123 5/1990 Berson et al. .
5,079,565 * 1/1992 Shimizu et al. ..... 400/208 X
5,152,621 * 10/1992 Tsuji ..... 400/208.1 X
5,595,447 * 1/1997 Takayama et al. ..... 400/231
5,620,265 * 4/1997 Kondo ..... 400/196

FOREIGN PATENT DOCUMENTS 0 094 035 5/1983 (EP) .

* cited by examiner

*Primary Examiner*—John S. Hilten
*Assistant Examiner*—Minh Chau
(74) *Attorney, Agent, or Firm*—J. William Wigert, Jr.; Crosby, Heafey, Roach & May

(57) ABSTRACT

The reuse of an ink ribbon is prevented and the image quality and the proper paper feeding operation are secured by providing an ink ribbon damaging means to a ink ribbon cartridge of a color video printer. For example, a ring cutter is provided to the spool shaft of a spool on which an ink ribbon used for printing is wound so that the ink ribbon wound on the spool is cut.

8 Claims, 17 Drawing Sheets

INK RIBBON CARTRIDGE INCLUDING INK RIBBON DAMAGING MEANS AND ROTATION DIRECTION RESTRICTING MEANS

BACKGROUND OF THE INVENTION

1. Field of the Invention

This invention relates to an ink ribbon use restriction unit provided to prevent improper use of an ink ribbon used for, for example, a video printer.

2. Description of Related Art

Color video printers, which print an image taken at that time on sealing photographic papers, have been popular in the field of, for example, amusement in recent years.

As a color video printer used in this field, for example, the printer of sublimation thermal printing are widely used, for example, three ink ribbons of yellow, cyan, and magenta are used and the respective color inks are thermally transferred on a photographic paper by means of a thermal head to print an image.

For example, the above-mentioned ink ribbon comprises a long vinyl sheet ribbon having a width corresponding to the vertical or horizontal size of a specified photographic paper, a supply spool on which a vinyl sheet ink ribbon is wound, and a winding spool for winding up the ink ribbon which has been used for printing, and an ink ribbon itself is fabricated in the form of a cartridge which is detachable to the printer. An ink cartridge usually has a printing capacity for printing, for example, about 200 sheets of photographic paper.

Some color video printer users use an ink cartridge until all the printable sheet portion of an ink ribbon is wound entirely on a winding spool and then rewind the used ink ribbon of the ink ribbon cartridge on a supply spool, and then reuse the used ink ribbon, with doing a foul trick by use of the above-mentioned structure of an ink ribbon cartridge.

Such reuse of an ink ribbon gives naturally an image, which is printed on a photographic paper, of poorer image quality than that of an image to be resulted from a fresh ink ribbon because ink of the reused ink ribbon is partially blanked when it has been used first.

The specific photographic paper which should be used for the color video printer is recommended to secure the good image quality and smooth paper feeding operation, however, some users who reuse a used ink ribbon cartridge often use the un-recommended photographic paper instead of the recommended photographic paper. In such case, the printed image quality becomes poorer further and in addition, for example, operational trouble such as that an ink ribbon is not peeled off smoothly from a photographic paper is caused often when ink is thermally transferred onto the photographic paper by means of a thermal head because a photographic paper which is not recommended is used.

SUMMARY OF THE INVENTION

The present invention was accomplished to solve the above-mentioned problem, and it is the object of the present invention to prevent the reuse of an ink ribbon, and resultantly to maintain the good printed image quality and to avoid the operational trouble of a printer.

An ink ribbon cartridge having an ink ribbon feeding mechanism comprising a supply spool, an ink ribbon wound on a winding spool, and an ink ribbon holder for supporting the ink ribbon is provided with an ink ribbon damaging means, thereby the prescribed portion of the ink ribbon once used for printing is damaged.

An ink ribbon cartridge is provided with a rotation direction restricting means for allowing the rotation in proper direction for printing and for preventing the rotation in the direction reverse to the proper direction of at least one of the supply spool and the winding spool, thereby at least one of the supply spool and the winding spool is not rotatable in the direction reverse to the rotation direction for feeding the ink ribbon for printing.

BRIEF DESCRIPTION THE DRAWINGS

DETAILED DESCRIPTION OF THE PREFERRED EMBODIMENTS

Embodiments of the present invention will be described in detail hereinafter with reference to the drawings. The ink ribbon use restriction unit in accordance with the present embodiment is to be incorporated in an ink ribbon cartridge together with a printing ink ribbon and a feeding/winding mechanism, which ink ribbon cartridge is set detachably to, for example, a thermally sublimation transfer type color video printer for amusement.

The explanation will be described according to the following order.

1. Color video printer 1-1. Basic structure of ink ribbon cartridge 1-2. Outline of operation of color video printer 2. Ink ribbon damaging mechanism 2-1. (First embodiment)

2-2. (Second embodiment)

2-3. (Third embodiment)

2-4. (Fourth embodiment)

3. Restriction mechanism of rotation direction of spool (Fifth embodiment)

1. Color video printer 1-1. Basic structure of ink ribbon cartridge

The basic structure of an ink ribbon cartridge in accordance with the present embodiment is described with reference to FIG. 1 prior to the explanation of the mechanism (ink ribbon use restriction unit) used as an ink ribbon use restriction unit for an ink ribbon cartridge in accordance with the present embodiment.

Figure 1:
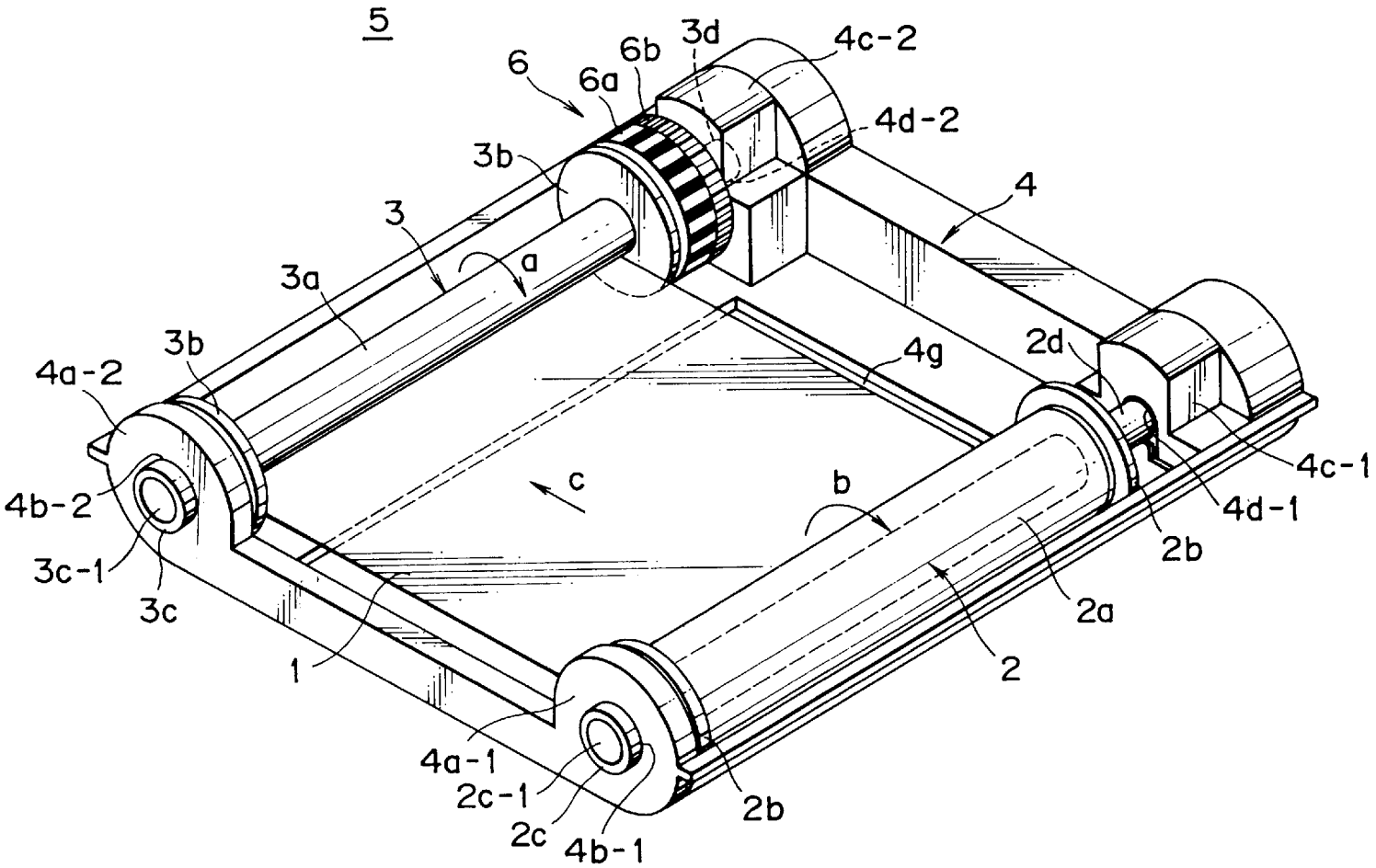
FIG. 1 is a perspective view for illustrating the basic structure of an ink ribbon cartridge in accordance an embodiment of the present invention.
Figure 2:
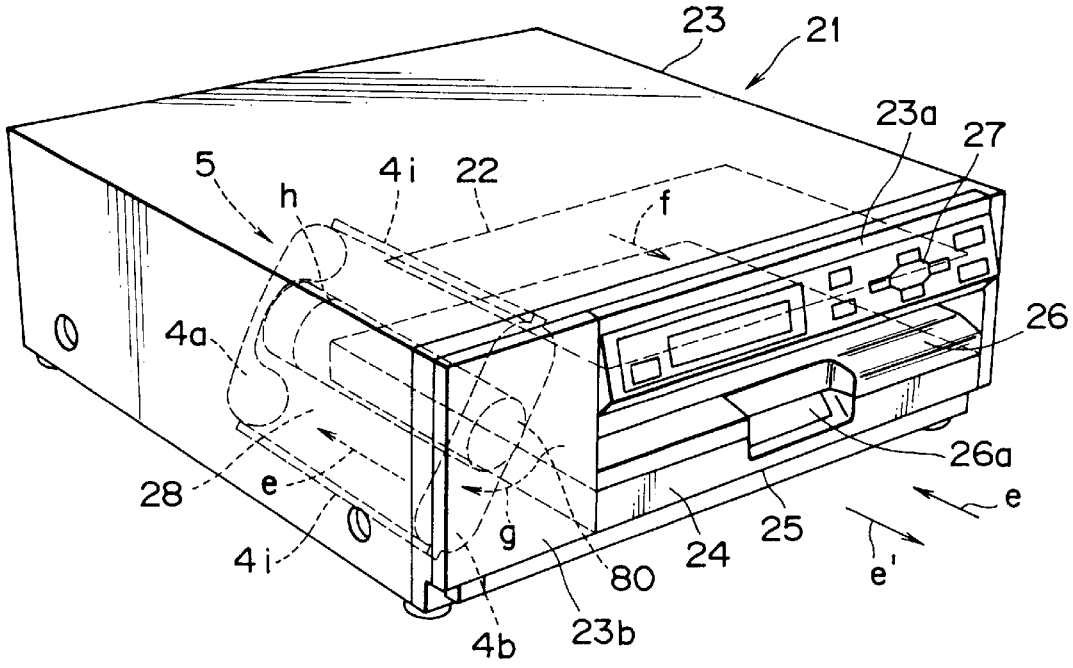
FIG. 2 is a perspective view for illustrating an appearance of a printer which uses an ink ribbon cartridge in accordance with the present embodiment.

An ink ribbon use restriction mechanism is omitted in FIG. 1 for convenience of description, and only the basic structure of an ink ribbon cartridge is shown. The mechanism of the ink ribbon use restriction mechanism will be described hereinafter.

The ink ribbon cartridge 5 shown in FIG. 1 is attached detachably to a video printer as described hereinafter and used for printing on a photographic paper.

The ink ribbon cartridge 5 comprises an ink ribbon holder 4, a supply spool 2 and a winding spool 3 which are attached rotatably to the ink ribbon holder 4, and an ink ribbon 1 which is wound on the supply spool 2 and the winding spool 3.

The supply spool 2 has a spool shaft 2*a* on which the ink ribbon 1 is wound. The spool shaft 2*a* has flanges 2*b* and 2*b* for guiding the ink ribbon 1 when wound at the both ends thereof.

On the outside of the flanges 2*b* and 2*b*, rotation shafts 2*c* and 2*d* having a rotational center axis which is coincide with the rotational center axis of the spool shafts are provided. The rotation shaft 2*c* is inserted rotatably into a bearing bore 4*b*-1 formed on a bearing housing 4*a*-1 of the ink ribbon holder 4. The rotation shaft 2*d* is inserted rotatably into the bearing bore 4*d*-1 formed on a bearing block 4*c*-1. A spool driving shaft engaging hole 2*c*-1 for engaging with an engaging driving shaft, which rotationally drives the supply spool 2 on the color video printer side 23 described hereinafter, is formed on the rotation shaft 2*c*.

Similarly to the feeding spool 2, the winding spool 3 has a spool shaft 3*a* on which the ink ribbon 1 is wound, and flanges 3*b* and 3*b* for winding on both ends of the spool shaft 2*a*. Rotation shafts 3*c* and 3*d* on the outside of the respective flanges 3*b* and 3*b* are inserted rotatably into a bearing bore 4*d*-2 of a bearing block 4*c*-2 and a bearing bore 4*b*-2 of a bearing housing 4*a*-2 respectively of the ink ribbon holder 4.

A spool driving shaft engaging hole 3*c*-1 for engaging with a spool driving shaft which rotationally drive the winding spool 3 is formed on the rotation shaft 3*c*. Further, on the outside of the right side flange 3*b* in the drawing, a bar code gear ring 6 is provided rotatably to the rotation shaft 3*d*. The bar code gear ring 6 comprises a bar code ring 6*a* on which a bar code for indicating that, for example, this ink ribbon cartridge is a genuine parts in-accordance with the specification of the specified printer, and a gear 6*b* having gear teeth served for rotating the bar code gear ring 6, both bar code ring 6*a* and gear 6*b* are combined together.

The supply spool 2 and the winding spool 3 incorporated in the above-mentioned structure are supported rotatably by the ink ribbon holder.

One end of the ink ribbon 1 is fixed on the spool shaft 2*a* of the supply spool 2 with adhesive and the ink ribbon 1 is wound on the supply spool 2. Similarly, the other end of the ink ribbon 1 is fixed on the spool shaft 3*a* of the winding spool 3 with adhesive and the ink ribbon 1 is to be wound on the winding spool 3.

The other end of the ink ribbon 1, which is not used yet at all, is fixed on the spool shaft 3*a* of the winding spool 3 and all the area to be used for printing is mostly maintained wound on the spool shaft 2*a*.

On the ink ribbon 1, areas on which yellow, cyan, and magenta inks are coated in the predetermined order successively are arranged on a thin transparent sheet consisting of a material such as a synthetic resin for expressing full color.

A thermal head inserting opening 4*g* is formed on the ink ribbon holder 4 on the location corresponding to the position where the ink ribbon is drawn out between the supply spool 2 and the winding spool 2 as shown in FIG. 1.

The thermal head inserting opening 4*g* is an opening for allowing a thermal head to be inserted from the under side in the drawing to press the ink ribbon 1 onto a photographic paper when the printer prints an color image using the ink ribbon cartridge.

When the printer is operated for printing, respective yellow, cyan, and magenta inks coated on the ink ribbon 1 are transferred on a photographic paper, for example, every printing on one photographic paper, when, the supply spool 2 is rotated in the direction of arrow b and the ink ribbon 1 is moved in the direction of arrow c by rotating the winding spool 3 in the direction of arrow a every time when the respective color areas are used, and fresh printing area of the ink ribbon 1 is drawn out successively to the place corresponding to the thermal head inserting opening 4*g*.

1-2. Outline of operation of color video printer

Next, the outline of the structure and operation of the printer for printing by use of the ink cartridge 5 shown in FIG. 1 is described with reference to FIG. 2 to FIG. 8.

The color printer 21 shown in FIG. 2 to FIG. 8 is a printer for printing a color image on a printing paper 22 prepared by cutting a photographic paper to a desired size. An insertion opening 25 of a recording paper tray 24, a printed paper discharge opening 26 for printing papers, and an operation panel 27 are provided on the front panel 23*a* of the printer body 23 near the one end side (right side position in FIG. 2) in the order from the bottom. A printing unit 28 is contained in the printer body 23 near the one end side (left side in FIG. 2) of the mounting position of the recording paper tray 24, and a platen 80 of the printing unit 28 is located in parallel to the direction of arrow f, which is coincident with the paper discharging direction of the paper discharging unit described hereinafter. An openable front panel 23*b* of the printing unit 28 is opened, and the ink cartridge 5, which has been described herein above, is inserted in the direction of arrow e through the opened front panel 23*b* and set detachably in the printing unit 28. When the ink ribbon cartridge 6 is set, both spools 2 and 3 are set respectively above and under the platen 80 in parallel, and the ink ribbon 1 is set between the platen 80 and the thermal head 83 in parallel to the platen 80 and the thermal head 83. The spool driving shaft engaging holes 2*c*-1 and 3*c*-l of both spools 2 and 3 are engaged coaxially with a pair of outside spool driving shafts in the printing unit 28, and the thermal head inserting opening 49 is set facing to the thermal head 83.

Many printing papers 22 are stacked vertically and accommodated in the recording paper tray 24, and the recording paper tray 24 is inserted horizontally from the direction of arrow e into the printer body 23 and locked. When printing starts, the uppermost printing paper 22 in the recording paper tray 24 is fed by means of a paper feeder, which will be described hereinafter, from the under side to the platen 80 of the printing unit 28 from the direction of arrow g perpendicular to the direction of arrow e, in which direction the recording paper tray 24 is inserted. After printing, the printing paper 22 is discharged from the upper side of the platen 80 of the printing unit 28 to the upper position of the recording paper tray 24 in the direction of arrow h, which is the reverse direction to the direction of arrow g. Subsequently, the printing paper 22 is discharged by means of a paper discharger in the direction of arrow f which is the direction reverse to the insertion direction of the recording paper tray 24 and which is the direction perpendicular to the direction of arrow h in which direction the printing paper 22 is transferred, and discharged horizontally from the printed paper discharge opening 26.

Figure 5:
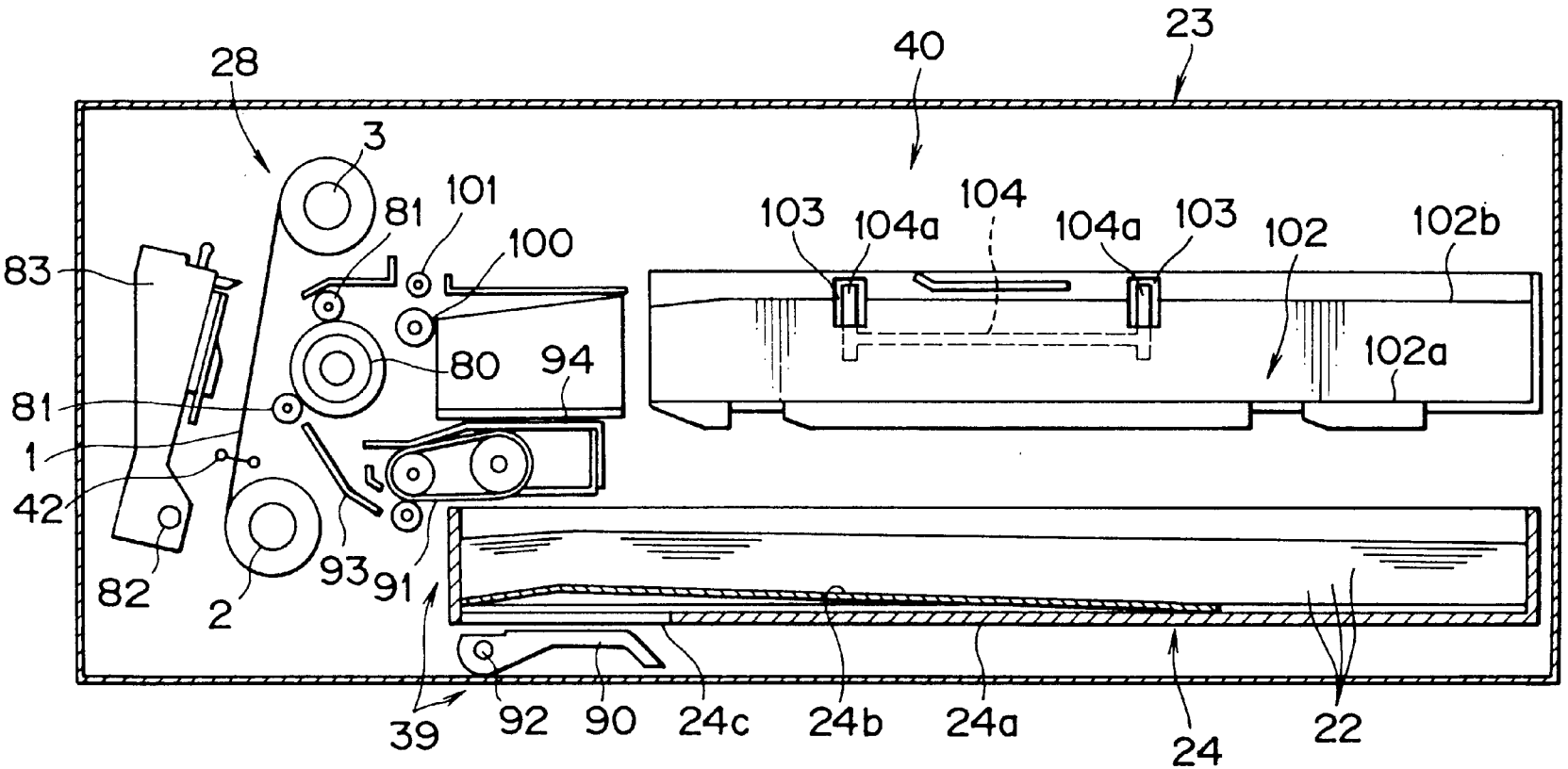
FIG. 5 is a cross sectional front view before printing operation of a color video printer.

Next, respective modes of the color video printer is described in the order with reference to FIG. 5 to FIG. 8. First, FIG. 5 shows the recording paper tray 24 which is mounted in the printer body 23, a paper receiving plate 24*b* is placed on the bottom 24*a* of the recording paper tray 24, and many printing papers 22 which are stacked on the paper receiving plate 24*b* are accommodated in the recording paper tray 24. The recording paper tray 24 is inserted between a paper feeding lever 90, which is a component of the paper feeder 39 provided on the bottom of the printer body 23, and a paper feeding belt 91, and an opening 24*c* formed on the bottom 24*a* of the recording paper tray 24 is set just above the paper feeding lever 90.

Figure 6:
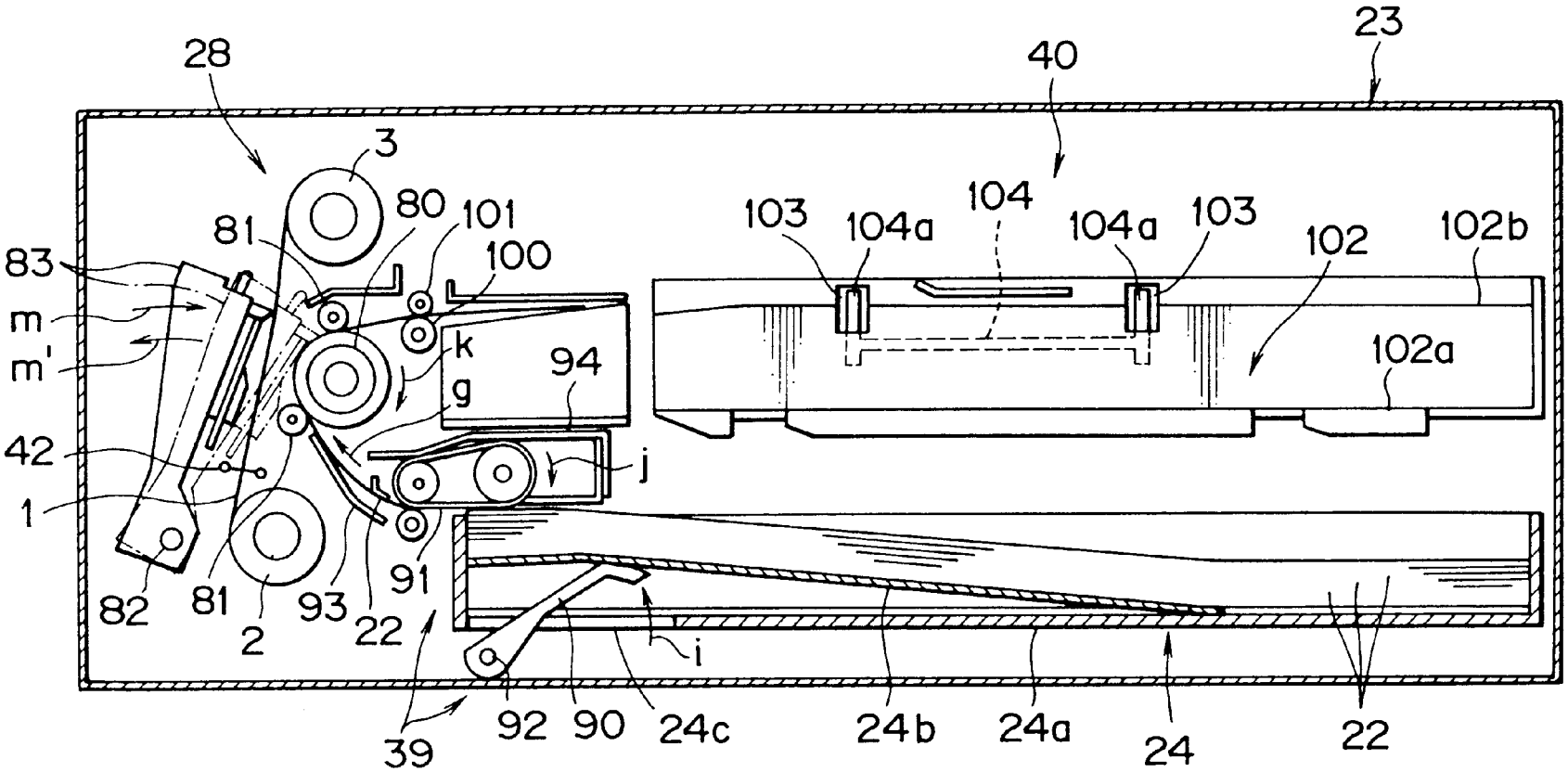
FIG. 6 is a cross sectional front view for illustrating the paper feeding mode of the color video printer.

Next, FIG. 6 shows the paper feeding mode, the paper feeding lever 90 of the paper feeder 39 is driven rotationally by means of a rotation shaft 92 upward in the direction of arrow i, the paper feeding lever 90 is inserted from the under position into the recording paper tray 24 through the opening 24*c* to push up the paper receiving plate 24*b,* and the uppermost printing paper 22 is pressed against the paper feeding belt 91 upward. When the paper feeding belt 91 and the platen 80 of the printing unit 28 are driven rotationally respectively in the direction of arrows i and k, the uppermost printing paper 22 is moved in the direction of arrow g, and the printing paper 22 is guided by a paper feeding guide 93 and wound on the outer periphery of the platen 80 upward.

A pair of pinch rollers 81 pressed against the outer periphery of the platen 80 which is rotating in the direction of arrow k to rotate synchronously with the outer periphery of the platen 80 is provided. The thermal head 83 which is turned in the direction of arrow m round a rocking lever shaft 82 temporarily only immediately after starting of paper feeding as shown with a dash-single-dot line and thereafter returns to the original position in the direction of arrow m' is provided. The pair of pinch rollers 81 and the thermal head 83 guide the printing paper 22 to wound it on the outer periphery of the platen 80 in the direction of arrow g.

Figure 7:
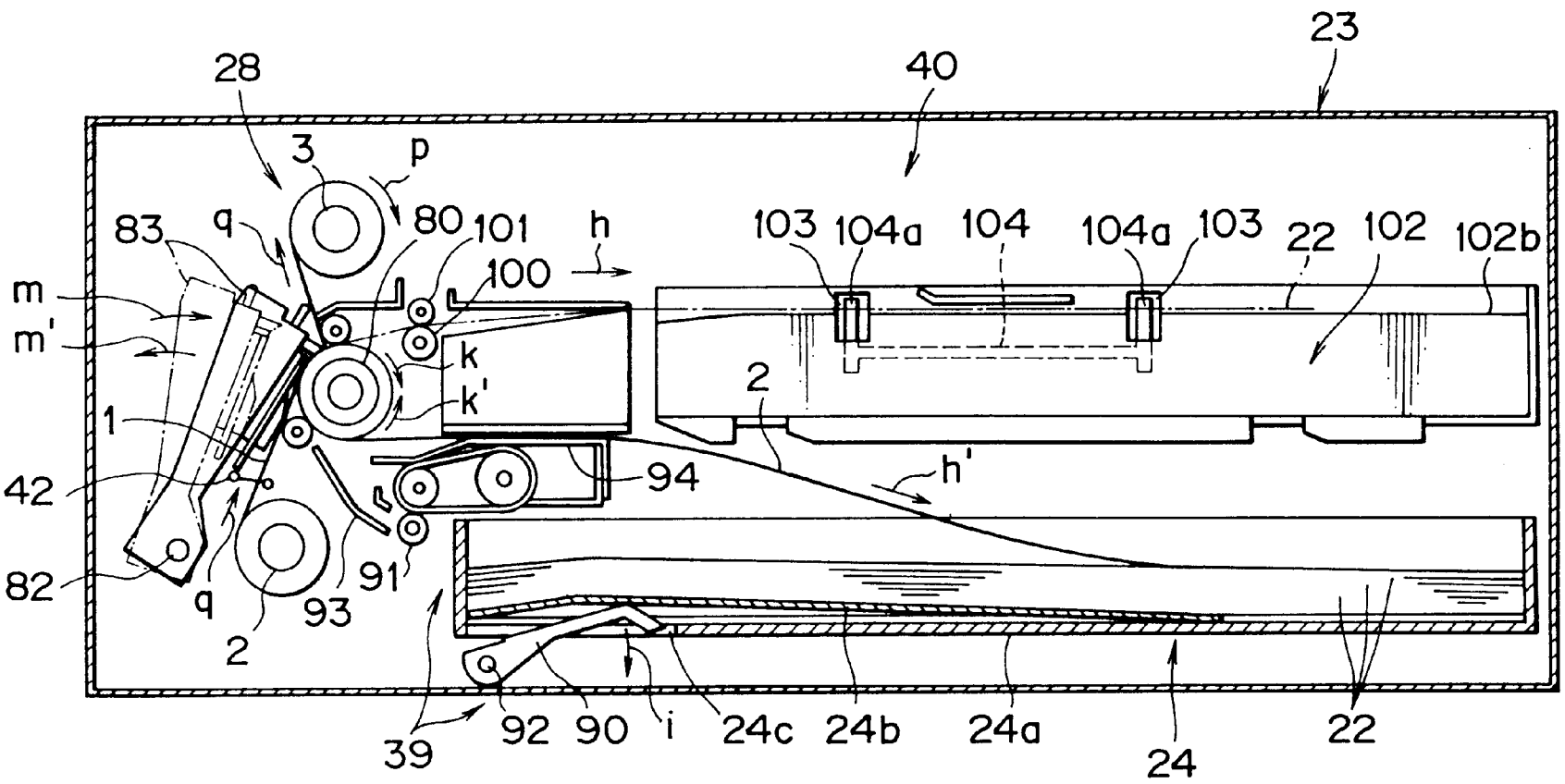
FIG. 7 is a cross sectional front view for illustrating the printing mode of the color video printer.

The printing paper 22 is moved to the position shown with a dash-single-dot line in FIG. 7 in the direction of arrow h, and thereafter the paper feeding lever 90 is returned to the printing position in the direction of arrow i' as shown in FIG. 7, the platen 80 is reversely driven rotationally in the direction of arrow k' to move the printing paper 22 reversely in the direction of arrow h' as shown in FIG. 7 with a solid line and sets at the printing starting position on a paper feeding table 94 provided on upper both sides of the paper feeding belt 91. During the above-mentioned operation, the thermal head 83 remains apart from the platen 80 in the direction of arrow m' as shown in FIG. 7 with a dash-single-dot line.

Next, FIG. 7 shows the printing mode, the ink ribbon 1 is wound on the supply spool 2 and the winding spool 3 provided respectively above and beneath the platen 80 and is set vertically between the platen 80 and the thermal head 83. On the surface of the platen 80 side of the ink ribbon 1, sublimable cyan, magenta, and yellow (three primary colors) colorants are coated in a pattern repeated with a certain pitch.

As shown in FIG. 7 with a solid line, the thermal head 83 is turned round the center of the rocking lever shaft 82 in the direction of arrow m to be pushed into the thermal head inserting opening 49 of the ink ribbon cartridge 5. The colorants of the ink ribbon 84 is pressed against the printing paper 22 on the outer periphery of the platen 80 in the direction of arrow by the thermal head 82, and simultaneously the platen 80 is driven rotationally in the direction of arrow k. As the result, the printing paper 22 is moved in the direction of arrow k and the ink ribbon 1 is moved out together with the printing paper 22 in the direction of arrow q by the action of friction torque between the print paper 22 and the ink ribbon 1 to complete the first printing process. The ink ribbon 1 moved out in the direction of arrow q is wound on the winding spool 85 in the direction of arrow p.

In the first printing process, the cyan colorant of the ink ribbon 84 is sublimated thermally by the thermal head 83 for thermal transfer, and a cyan image is printed on the printing paper 22.

Next, as shown in FIG. 7 with a dash-single-dot line, the thermal head 83 is move apart from the platen 80 in the direction of arrow m', the platen 80 is reversely rotated in the direction of arrow k' to return the printing paper 22 onto the paper feeding table 94 in the direction of arrow h', and the second printing process is operated in the same manner as described herein above to sublimate and thermally transfer magenta colorant of the ink ribbon 1, as the result the magenta colorant is printed on the cyan image of the printing paper 22. The third printing process is operated in the same manner as described herein above to sublimate and thermally transfer yellow colorant of the ink ribbon 1, and as the result an yellow image is printed on the cyan and magenta images of the printing paper 22 to complete a color image synthesized with cyan, magenta, and yellow colorants.

Figure 8:
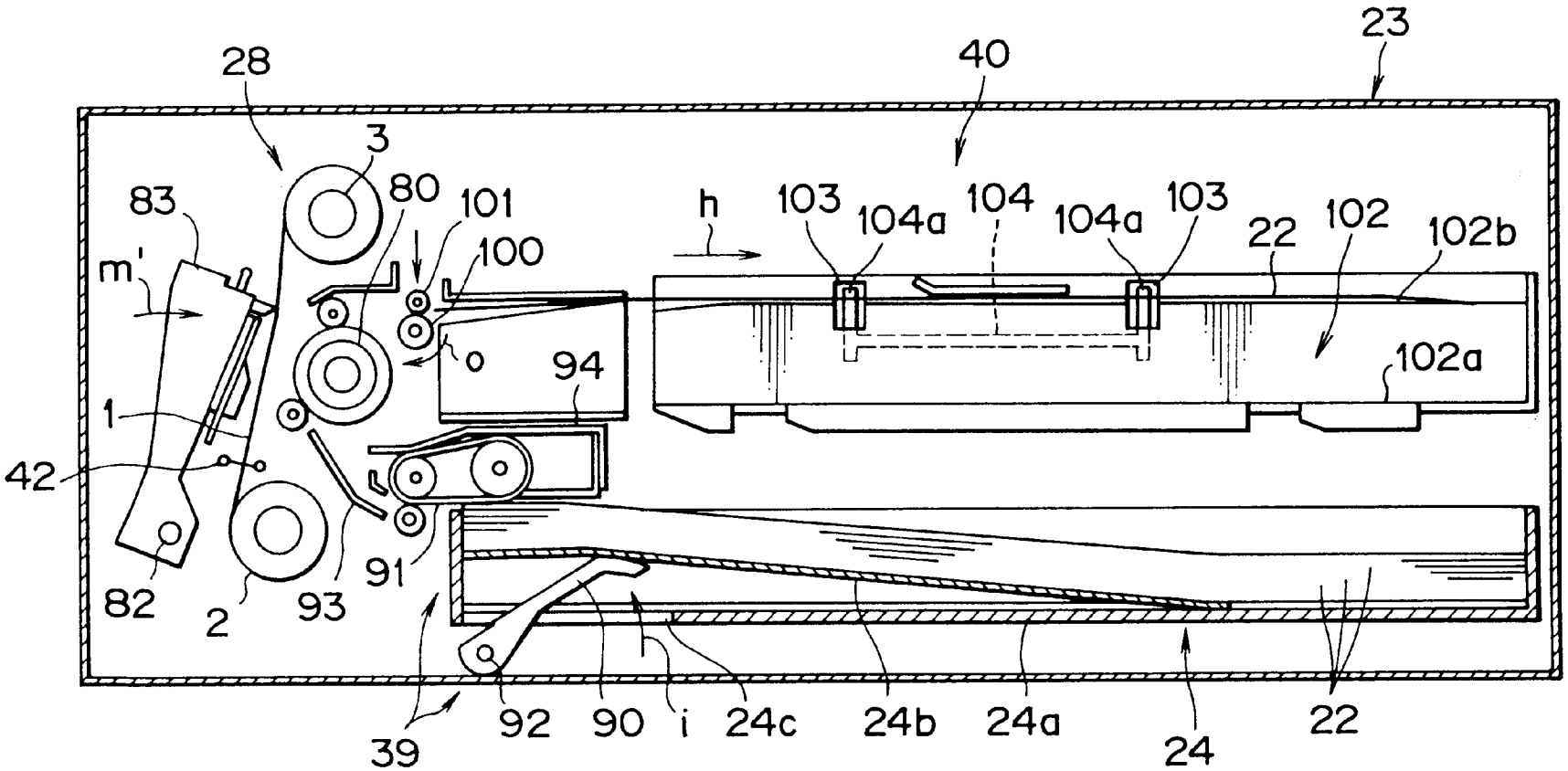
FIG. 8 is a cross sectional front view for illustrating the paper discharging mode of the color video printer.

Next, FIG. 8 shows the paper discharging mode, after completion of the printing process, a discharging roller 100 provided on the upper right position from the platen 80 is driven rotationally in the direction of arrow k to discharge the printing paper 22, which is pressed against a pinch roller 101 by the discharging roller 100, in the direction of arrow h, and the printing paper 22 is placed on a paper discharging table 102 of the paper discharging unit 41, which will be described herein after. Subsequently, the paper discharging unit 41 discharges the printing paper 22 in the direction of arrow f shown in FIG. 2 and the printing paper is moved out to the paper discharging opening 26.

Next, the outline of the paper discharging unit is described with reference to FIG. 3 and FIG. 4. The paper discharging table 102 is provided on the position above the mounting position of the recording paper tray 24 in the printer body 23 and on the side of the platen 80 of the printing unit 28. The paper discharging table 102 comprises a flat lower part 102*a* connected to the paper discharging opening 26 and a higher part 102*b* positioned at the same level as the discharging roller 100 in the stepwise form. The higher part 102*b* has a pair of slits 103 parallel to the direction of arrow f, which is the paper discharging direction, a paper discharging lever 104 having a pair of parallel and vertical paper discharging arms 104*a* which extends above the higher part 102*b* is provided through the pair of slits 103, which paper discharging lever 104 is rotatable round the rocking lever shaft 105 in the direction of arrows n and n'.

Figure 3:
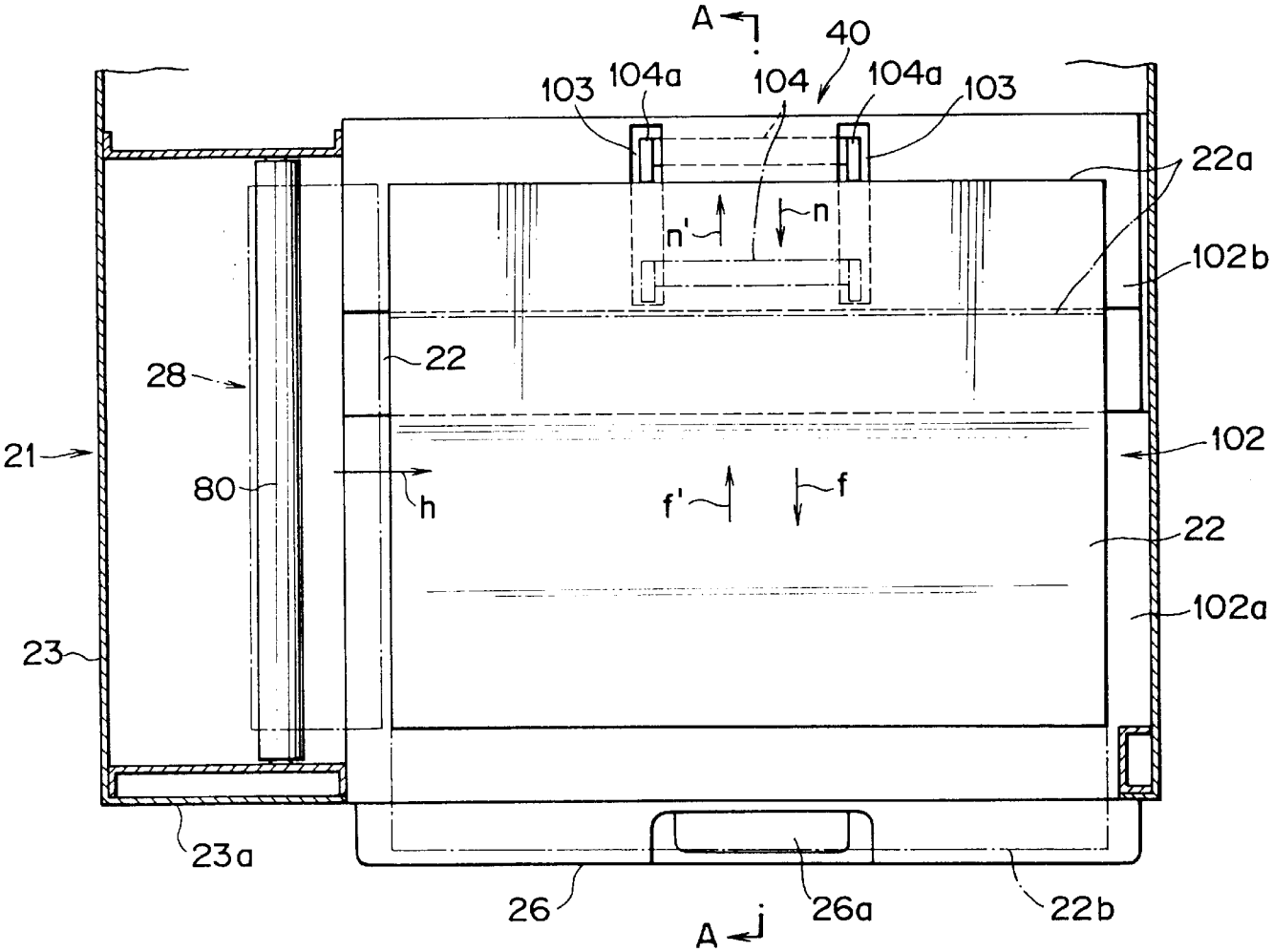
FIG. 3 is a partially cut-away plan view of FIG. 2.
Figure 4:
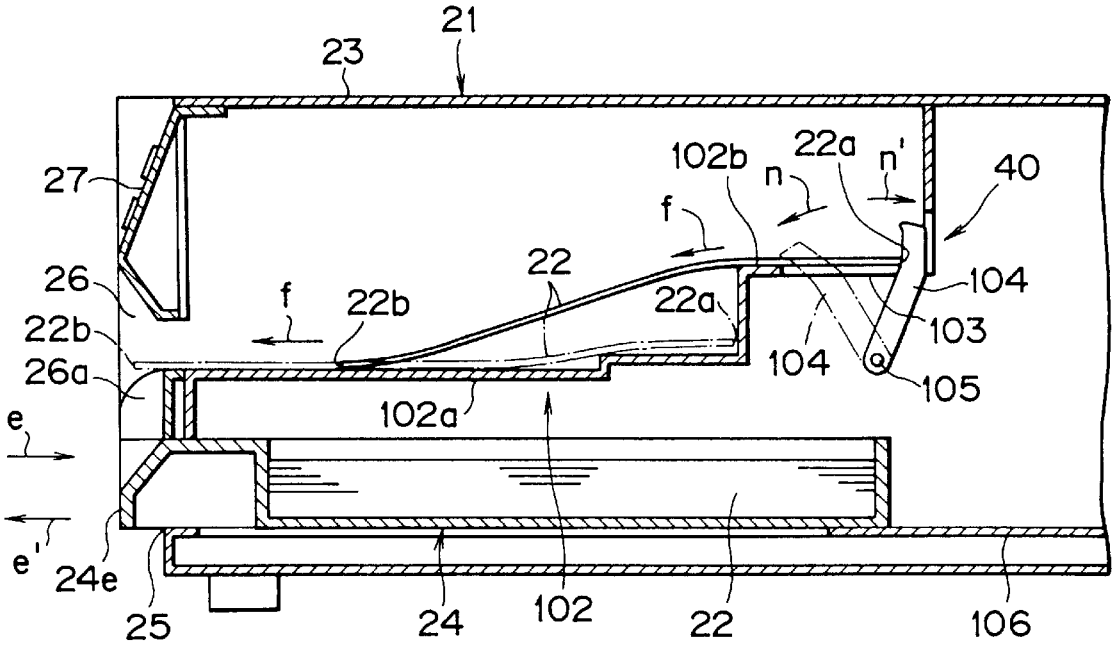
FIG. 4 is a cross sectional view taken in the direction of the arrow along the line A—A in FIG. 3.

As shown in FIG. 3 and FIG. 4 with a solid line, the printing paper is discharged from the platen 80 in the direction of arrow h after completion of the printing, and the printing paper is laid between the lower part 102*a* and the higher pat 102*b* of the paper discharging table 102. Next, the paper discharging lever 104 is turned in the direction of arrow h from back motion position shown with a solid line to the forward motion position shown with a dash-single-dot line in FIG. 3 and FIG. 4, as the result the pair of paper discharging arms 104*a* pushes the rear end of the printing paper 22 at two point in the direction of arrow f.

When, the printing paper 22 is pushed out in parallel to the direction of arrow f, and the printing paper 22 is slid to fall down from the higher part 102*b* to the lower part 102*a* of the paper discharging table 102 in the direction of arrow d as shown in FIG. 3 and FIG. 4 with a chin line, and the front end 22*b* of the printing paper 22 is sent out to the paper discharging opening 26 formed under the operational panel 27 of the printer body 23. An operator can pull out the printing paper 22 outside the paper discharging table 26 by inserting its fingers into the convex 26*a* formed on the bottom center of the paper discharging opening 26. A sensor 43 shown in FIG. 5 to FIG. 8 is provided to detect respectively the positions of cyan, magenta, and yellow colorants of the ink ribbon 1.

2. Ink ribbon damaging mechanism 2-1. (First embodiment)

Subsequently, examples of ink ribbon damaging mechanisms which feature the present embodiment are described. The ink ribbon damaging mechanism in accordance with the present embodiment cuts a ink ribbon which has already used for printing through the printing operation as described herein above and wound on the winding spool 3 in order to prevent the second use by damaging the wound ribbon even if a user rewinds the ink ribbon after the first printing.

The case that an ink ribbon breakdown mechanism is attached to the ink ribbon cartridge 5 shown previously in FIG. 1 is described hereinafter, the same components as shown in FIG. 1 are given the same characters as use in FIG. 1, and the description will be omitted.

First, an ink ribbon damaging mechanism in accordance with the first embodiment is described with reference to FIG. 9, FIG. 10A, and FIG. 10B.

Figure 9:
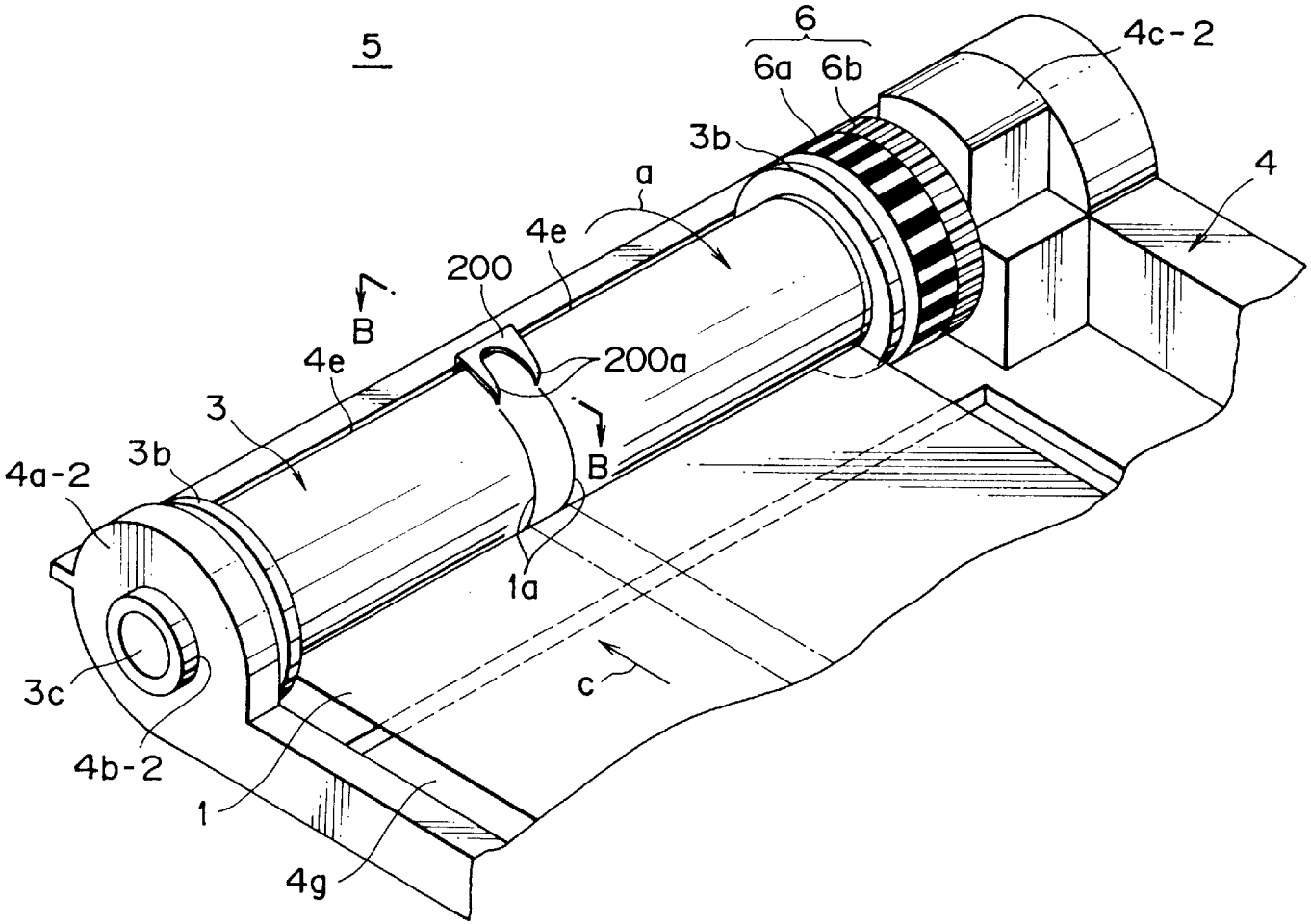
FIG. 9 is a perspective view for illustrating an ink ribbon damaging mechanism in accordance with the first embodiment.
Figure 10B:
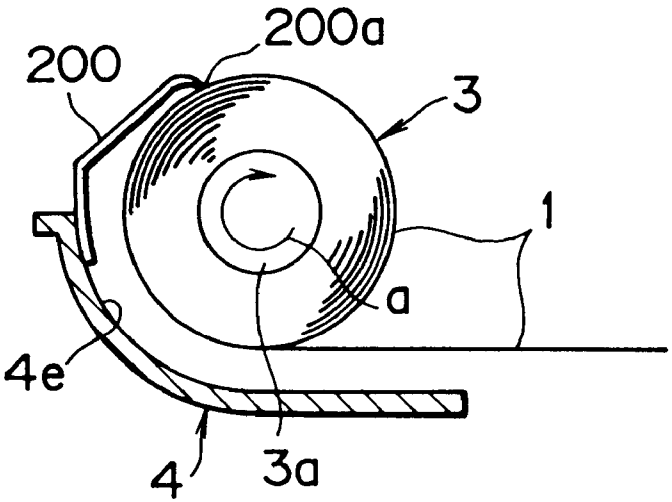
FIG. 10A and FIG. 10B are cross sectional views taken in the direction of the arrow along the line B—B in FIG. 9 for illustrating the operation of the ink ribbon damaging mechanism in accordance with the first embodiment.
Figure 10A:
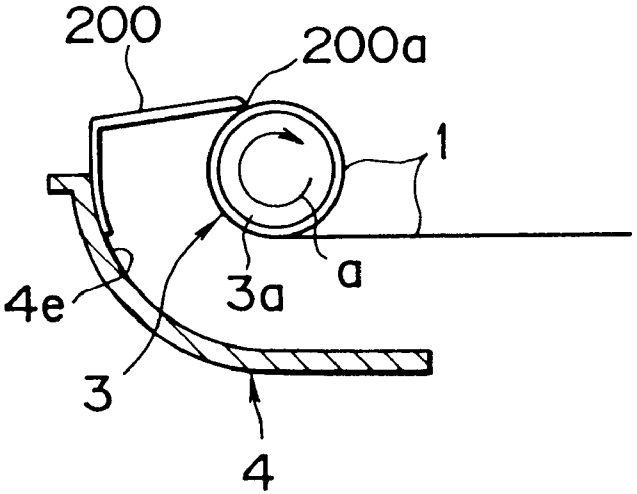

FIG. 9 shows a partial perspective view of the ink cartridge 5 provided with the ink ribbon damaging mechanism in accordance with the first embodiment around the winding spool 3, and FIG. 10A and FIG. 10B are cross sectional views taken in the direction of the arrow along the line B—B in FIG. 9.

As shown in FIG. 10A and FIG. 10B, in the first embodiment, for example, a claw blade spring 200 as shown in FIG. 9 is provided.

The claw blade spring 200 is a spring formed by shaping a sheet member consisting of, such as, elastic metal in a form as shown in the drawing, and the claw blade spring 200 has a pair of blades 200*a* and 200*a* which are so sharp as to cut or break one sheet of the ink ribbon 1 having a some thickness. The blade 200*a* may be formed by simple work, for example, to sharpen the end of a blade spring.

In this case, the claw blade spring 200 is attached so that the bottom end of the claw blade spring 200 is fixed on the side inside wall 4*e* of the ink ribbon holder 4 and so that the end of the blade 200*a* is pressed against the spool shaft 3*a* with a pressure of pressing force of the blade spring.

Because the claw blade spring 200 is provided as described herein above, for example, when the spool shaft 3*a* is rotated in the winding direction of arrow a as shown in FIG. 10A for printing, the ink ribbon 1 wound on the spool 3*a* is cut scratchily by the blade 200*a* as the ink ribbon is wound. The ink ribbon 1 with the cut portion 1*a* as shown in FIG. 9 is wound on the spool shaft 3*a*. The dash-single-dot line shown on the ink ribbon 1 in FIG. 9 shows the portion which will be the cut portion 1*a* as the ink ribbon is wound on the spool shaft 3*a*.

When the quantity of the ink ribbon 1 wound on the spool shaft 3*a* increases as shown in FIG. 10B due to, for example, increased number of printing, the claw blade spring 200 is pressed continuously against the ink ribbon 1 wound on the spool shaft 3*a* with a pressing pressure of the elastic force, as the result, the cut portion 1*a* is continuously obtained consistently as shown in FIG. 9.

The above-mentioned claw blade spring 200 provided with the pair of two blades 200*a* and 200*a* is described herein above, however, the number of blades 200*a* is by no means limited to two, and may be one, three or more. A plurality of claw blade springs 200 may be provided. The detailed shape and method of attaching are by no means limited to the above-mentioned example shown in the drawings.

2-2. (Second embodiment)

Figure 11:
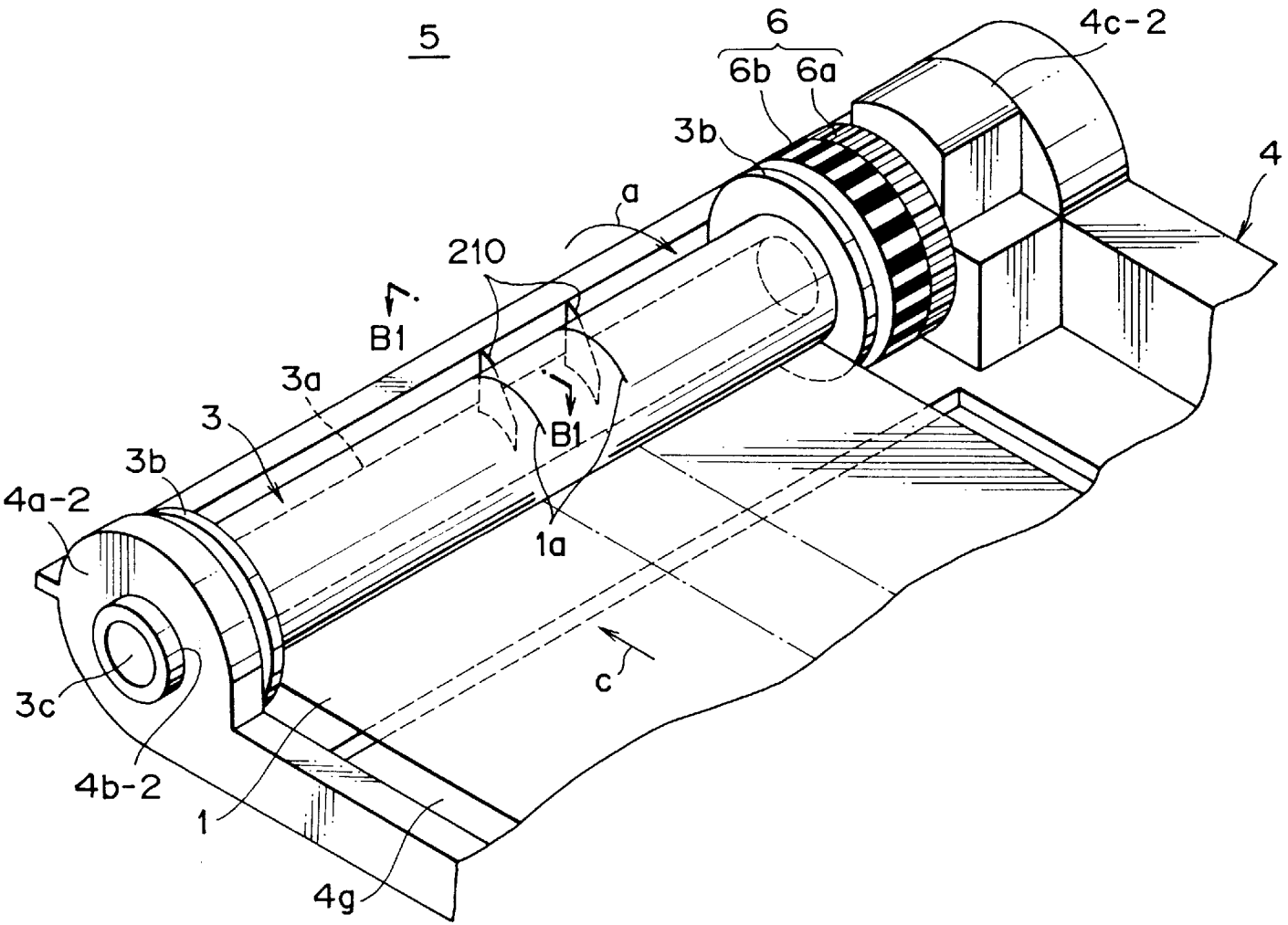
FIG. 11 is a perspective view for illustrating an ink ribbon damaging mechanism in accordance with the second embodiment.

Next, an ink ribbon damaging mechanism in accordance with the second embodiment is described with reference to FIG. 11 and FIG. 12A to FIG. 12D. FIG. 11 is a partial perspective view of the ink ribbon cartridge 5 around the winding spool 3 provided with an ink ribbon breakdown mechanism in accordance with the second embodiment, and FIG. 12A to FIG. 12D are cross sectional views taken in the direction of the arrow along the line B1—B1 in FIG. 11. In FIG. 11 and FIG. 12A to FIG. 12D, the same components shown in FIG. 9, FIG. 10A, and FIG. 10B are given the same characters, and the description is omitted.

In the second embodiment, a cutter 210 which is served as a blade is attached directly to the spool shaft 3*a* as shown in FIG. 11.

FIG. 12A to FIG. 12D show the operation corresponding to the rotation of the spool shaft 3*a*. For example, when the spool shaft 3*a* is rotated from the rotational position shown in FIG. 12A to the winding direction of arrow a, as shown by the transition from FIG. 12B to FIG. 12C, the blade of the cutter 210 cuts the ink ribbon 1 so that the blade is sticking in the ink ribbon 1 as the ink ribbon 1 is wound on the spool shaft 3*a*. In this case, the continuous cut portion 1*a* of the ink ribbon 1 is not obtained but the intermittent cut portions having a certain length along the direction of arrow c are obtained.

Figure 12A:
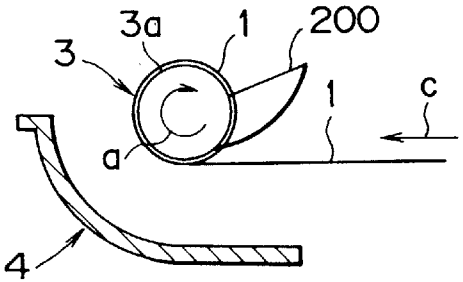
FIG. 12A to FIG. 12D are cross sectional views taken in the direction of the arrow along the line B1—B1 in FIG. 11 for illustrating the operation of the ink ribbon damaging mechanism in accordance with the second embodiment.
Figure 12B:
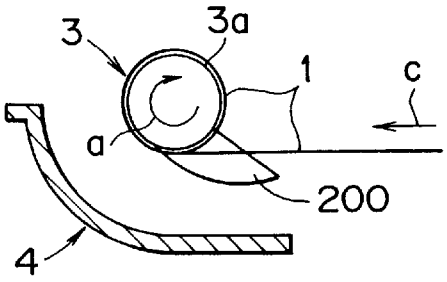
Figure 12C:
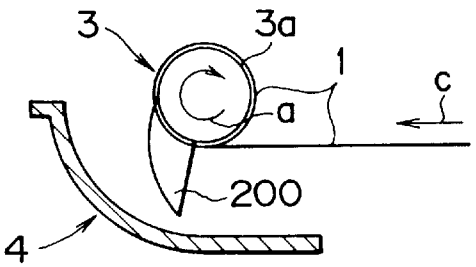
Figure 12D:
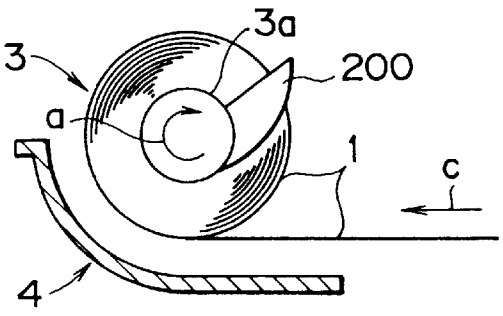

The height of the cutter 210 is prescribed so that the top end of the cutter is stuck through the ink ribbon 1 to the other side, for example, even when the ink ribbon 1 is wound fully on the spool shaft 3*a*. As the result, cut portions 1*a* on the ink ribbon 1 are obtained consistently event when the quantity of the ink ribbon 1 wound on the spool shaft 3*a* increases as shown in FIG. 12D as the number of printing increases.

In the case that a plurality of cutters 210 are provided as described herein above, the cutters are not necessarily arranged on a line as shown in FIG. 11, for example, the cutters 210 may be located with deviation each other on the radial position of the spool shaft 3*a*. In the second embodiment, the number and the detailed configuration of cutters 210 to be provided actually may be modified desirably.

2-3. (Third embodiment)

Figure 13:
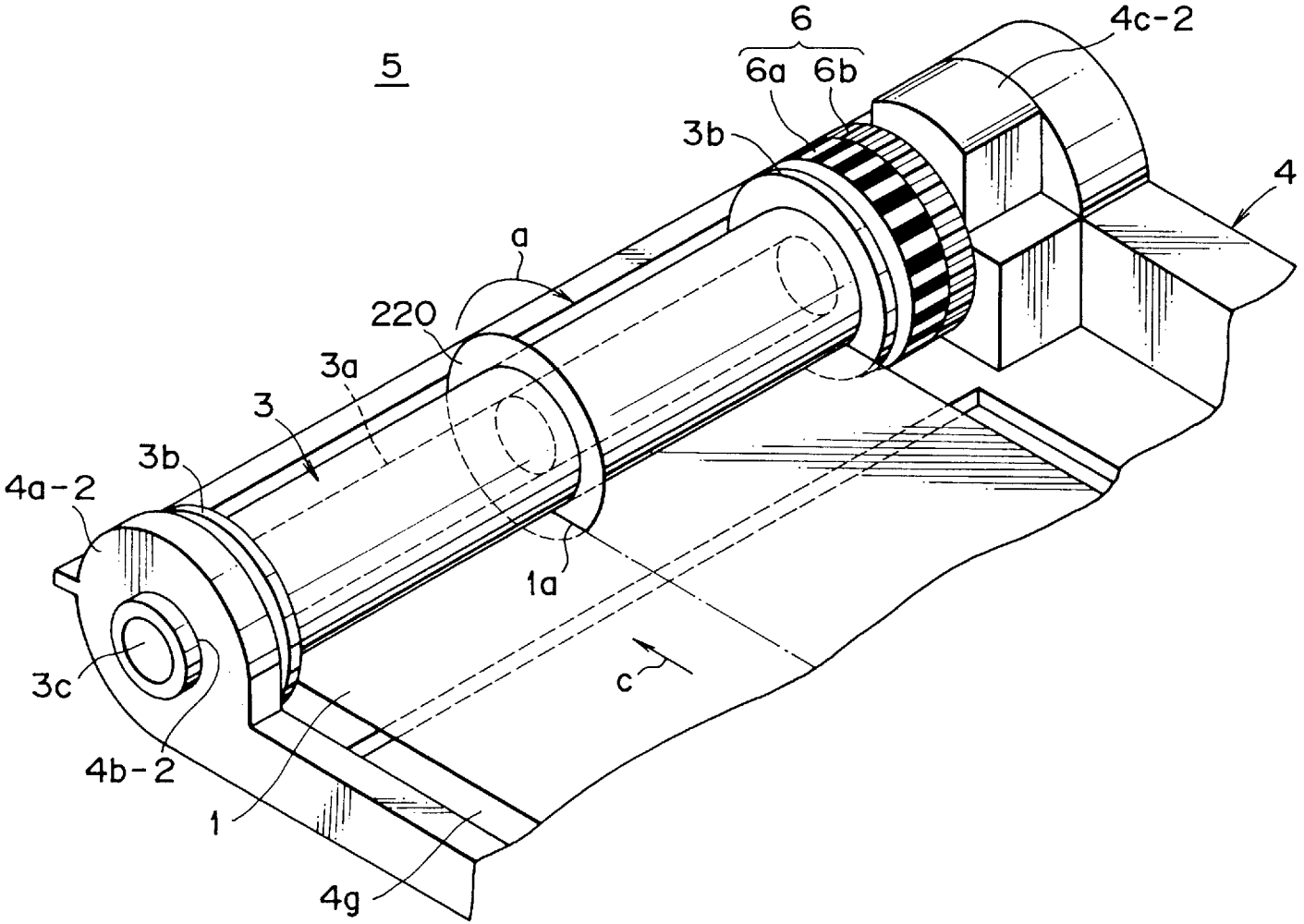
FIG. 13 is a perspective view for illustrating an ink ribbon damaging mechanism in accordance with the third embodiment.

FIG. 13 is a partial perspective view of the ink cartridge 5 which is provided with an ink ribbon damaging mechanism in accordance with the third embodiment, and the same components as shown in FIG. 9 and FIG. 11 are given the same characters, and the description is omitted.

In the third embodiment, a ring cutter 220 is fixed to the spool shaft 3*a* so that the cutter is provided on the entire periphery of the spool shaft 3*a* as shown in FIG. 13. The ring cutter 220 has a cutter blade on the entire periphery of the ring cutter 220.

The ring cutter 220 having the structure described herein above cuts the ink ribbon 1 which is wound on the spool shaft 3*a* in the direction of arrow c when the spool shaft 3*a* is rotated in the winding direction of arrow a. In this case, the cut portion 1*a* is the continuous cut. The diameter of the ring cutter 220 must be larger than the diameter of the wound ink ribbon 1 when the ink ribbon 1 is wound fully on the spool shaft 3*a*. For example, actually the diameter of the ring cutter 220 may be equal to, for example, the diameter of the flange 3*b*.

In the third embodiment, the number of ring cutters 220 may be arbitrary.

2-4. (The fourth embodiment)

Figure 14:
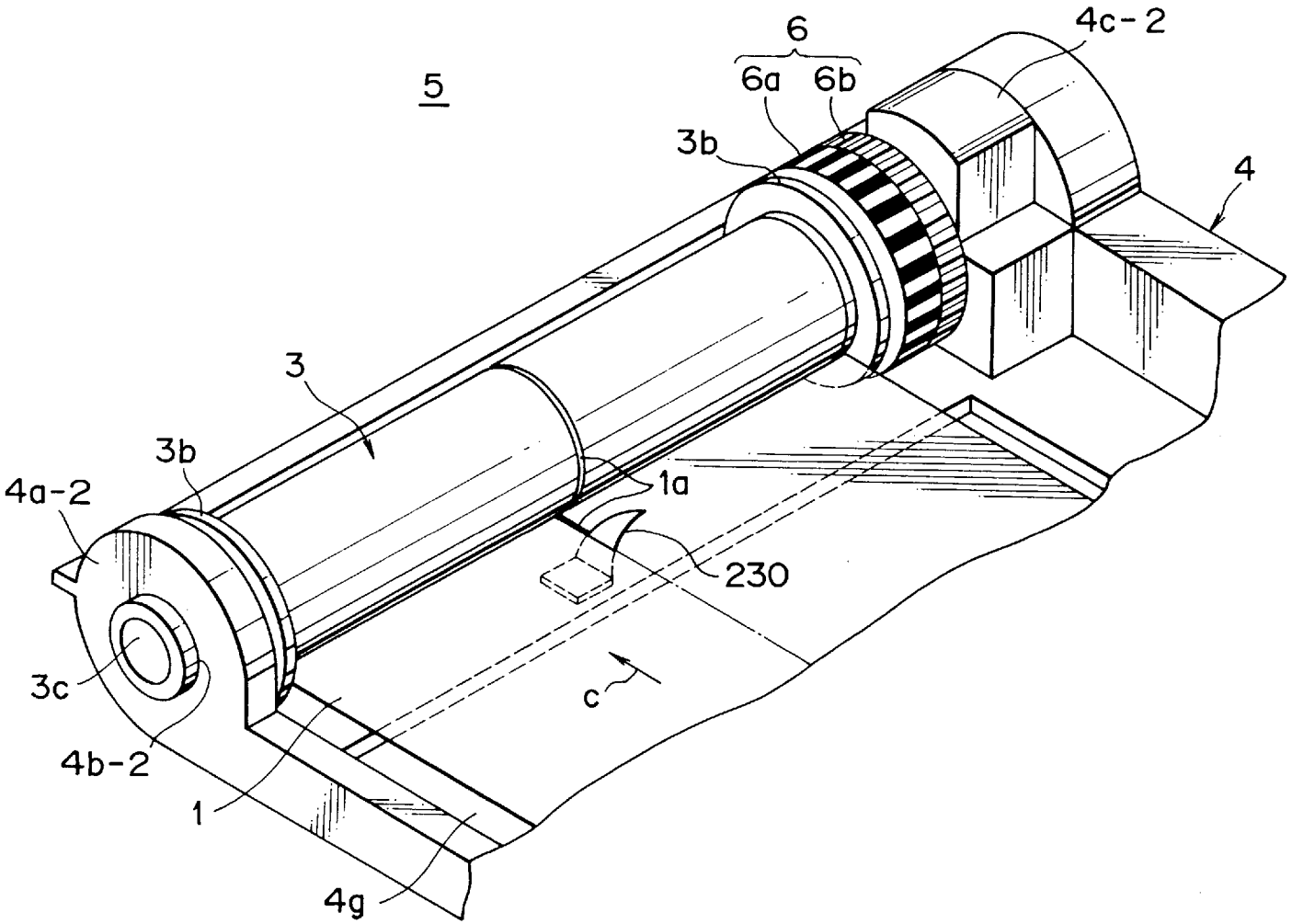
FIG. 14 is a perspective view for illustrating an ink ribbon damaging mechanism in accordance with the fourth embodiment.
Figure 15:
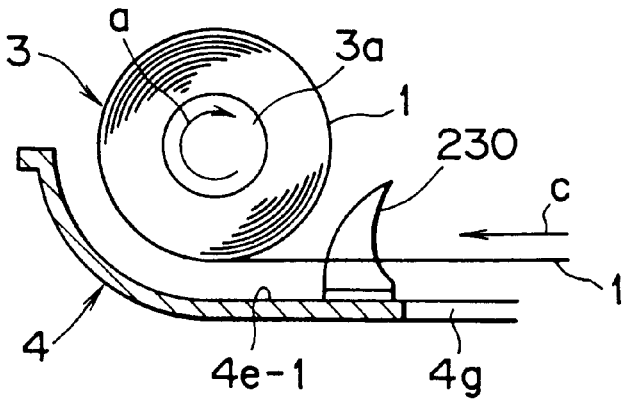
FIG. 15 is a cross sectional view for illustrating the ink ribbon damaging mechanism in accordance with the fourth embodiment.

Subsequently, an ink ribbon damaging mechanism in accordance with the fourth embodiment is described with reference to FIG. 14 and FIG. 15. FIG. 14 is a partial perspective view of the ink cartridge 5 provided with an ink ribbon damaging mechanism in accordance with the fourth embodiment, and FIG. 15 is a partial side cross sectional view around the cutter shown in FIG. 14. The same components as shown in FIG. 9 to FIG. 13 are given the same characters, and the description is omitted.

In the fourth embodiment, a cutter 230 is provided at the position just before the ink ribbon 1 is wound on the winding spool 3 as shown in FIG. 14 and FIG. 15.

In this case, the cutter 230 is located fixedly near the end of the thermal head insertion opening 4*g* on the bottom surface inside wall of the ink ribbon holder 4 at the position corresponding to the center of the spool shaft 3*a* in the longitudinal direction.

The ink ribbon 1 is cut continuously by the cutter 230 to form the cut portion 1*a* when the ink ribbon 1 is moved in the direction of arrow c as the ink ribbon 1 is wound on the spool shaft 3*a* synchronously with the rotation of the spool shaft 3*a* in the winding direction of arrow a.

The number and configuration of cutters 230 provided actually are by no means limited to those shown in the drawings.

2-5. Cover

Figure 16:
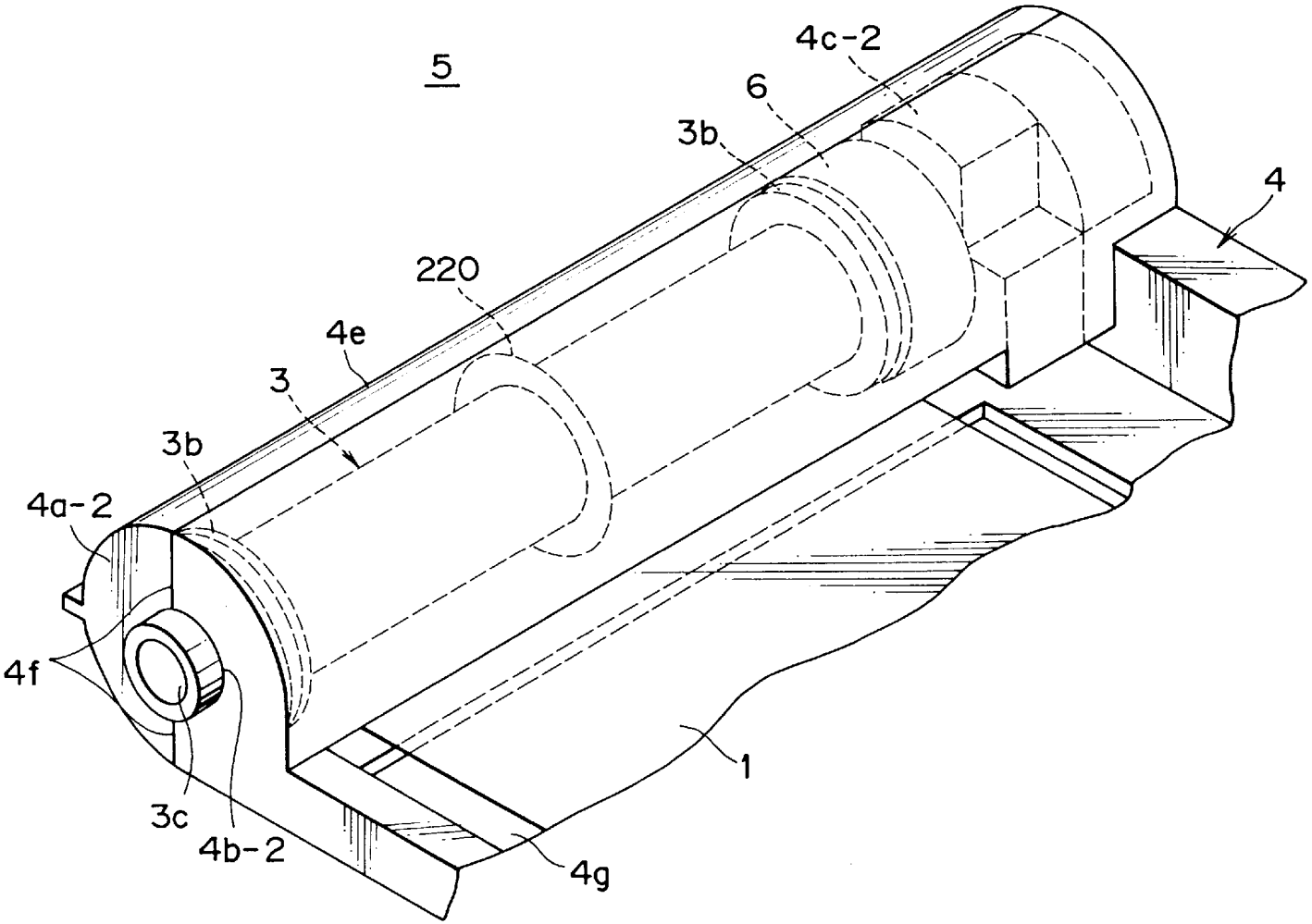
FIG. 16 is a perspective view for illustrating an exemplary spool cover provided to an ink ribbon damaging mechanism in accordance with the present embodiment.

In the above-mentioned first to fourth embodiments, members having blades for damaging the ink ribbon 1 are provided. To eliminate the risk of handling danger which could arise when an user actually uses an ink ribbon cartridge in accordance with the present embodiment, at least the winding spool 3 portion where the ink ribbon damaging mechanism is attached is preferably covered with a spool cover 4*e* as shown in FIG. 16. The spool cover 4*e* is structurally combined with the ink ribbon holder 4 as a part.

In FIG. 16, the structure in which a spool cover is provided to the structure in accordance with the third embodiment is shown, however of course, a spool cover 4*e* which has the structure suitable for other embodiments described hereinbefore may be provided. In effect, any spool cover 4*e* which prevents a user from touching and seeing directly the ink ribbon damaging mechanism in accordance with the present embodiment may be used.

In the case of the spool cover 4*e* shown in FIG. 16, for example, the bearing bore 4*b*-2 formed on the bearing housing 4*a*-2 is partially served commonly for the spool cover 4*e*. Further though not shown in FIG. 16, the bearing bore 4*d*-2 is also partially served commonly for the spool cover 4*e*. For example, the spool cover 4*e* is formed at the position where the joint 4*f* for joining the spool cover 4*e* to the ink ribbon holder 4 body divides the bearing bore 4*b*-2 into two halves.

For example, some users who want to reuse the ink ribbon cartridge 5 could detach the blade spring and cutter, which are components of the ink ribbon damaging mechanism described hereinbefore, to reuse the ink ribbon cartridge 5, however, even if a user tries to detach the blade spring and cutter, the ink ribbon cartridge itself which is structured as described herein above will be broken when the spool cover 4*e* is detached, and even if, for example, the spool cover 4*e* is attached again on the ink ribbon holder 4, it is difficult to rotate the spool properly. As the result, a user will not rarely want to refabricate an ink ribbon cartridge, the possibility of reuse is further reduced. Further, an ink ribbon breakdown mechanism can be made invisible by means of a spool cover 4*e* so that the existence of the ink ribbon damaging mechanism is unknown for users.

The combined structure of the spool cover 4*e* and the ink ribbon holder 4 and the configuration of the spool cover 4*e* is by no means limited to those shown in FIG. 16, as long as the combined structure of the spool cover 4*e* and the ink ribbon holder 4 and the configuration of the spool cover 4*e* function to cover the ink ribbon damaging mechanism and to prevent a user from touching directly the ink ribbon damaging mechanism and function to damage the proper operation of the ink ribbon cartridge 5.

In the embodiments described hereinbefore, examples in which an ink ribbon damaging mechanism is provided to an ink ribbon cartridge 5 which contains an ink ribbon 1 wound on a spool in a cartridge is described, however for example, an ink ribbon damaging mechanism may be provided to the printer side as an application of the present invention. In other words, an ink ribbon damaging mechanism is provided at the proper location in a printer so that the used portion of an ink ribbon set on the printer side is damaged in the printer when the portion is used.

3. Spool rotation direction restricting mechanism (fifth embodiment)

In the first to fourth embodiments described hereinbefore, an ink ribbon cartridge is structured so that an ink ribbon 1 is damaged to prevent a user from reusing the used ink ribbon 1 again, however otherwise, as described in the fifth embodiment, a structure to prevent a user from reusing a used ink ribbon 1 by restricting the spool rotation direction may be applied.

As described in the explanation of FIG. 1, both spools 2 and 3 are rotated only in the direction of arrows a and b respectively as long as the ink ribbon cartridge of the present embodiment is used properly. Conversely to say, rotation of the spools 2 and 3 in the direction reverse to the direction of arrows a and b implies, for example, the rewinding for the purpose of reusing by a user.

Reuse of an ink ribbon 1 is prevented also by providing a mechanism for making at least any one of a supply spool 2 and a winding spool 3 rotatable in the direction of arrows a and b but not rotatable in the reverse direction.

Figure 17:
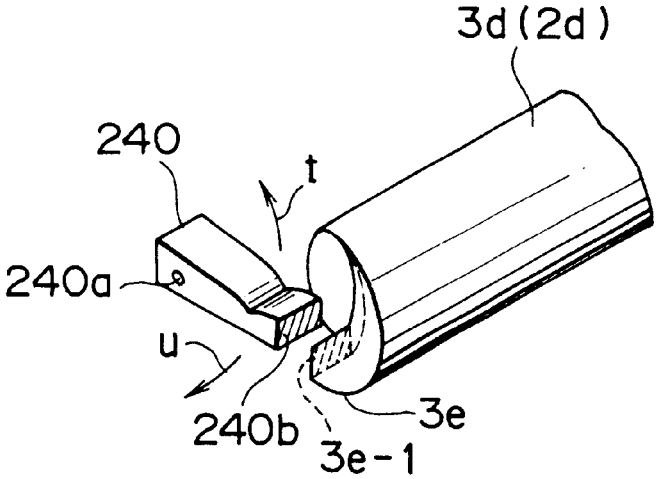
FIG. 17 is a perspective view for illustrating the structure of a spool rotation direction restricting mechanism (the fifth embodiment) in accordance with the present embodiment.

FIG. 17 is a perspective view for illustrating one example of a spool rotation direction restricting mechanism in accordance with the fifth embodiment, and FIG. 18A to FIG. 18E are views of the mechanism shown in FIG. 17 in the view along the rotation axis of the spool shaft for describing operation of the spool rotation direction restricting mechanism.

An exemplary spool rotation direction restricting mechanism which is provided to a winding spool 3 is described herein under. The spool rotation restricting mechanism is provided in, for example, the internal of a bearing block 4*c*-2.

The spool rotation direction restricting mechanism is provided by processing the end of the rotation shaft 3*d* to form a stopper pawl 3*e* as shown in FIG. 17 and FIG. 18A to FIG. 18E.

Figure 18A:
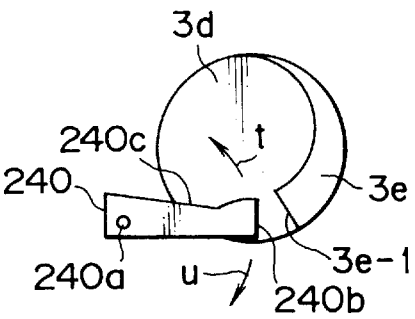
FIG. 18A to FIG. 18E are diagrams for illustrating the operation of the spool rotation direction restricting mechanism.
Figure 18B:
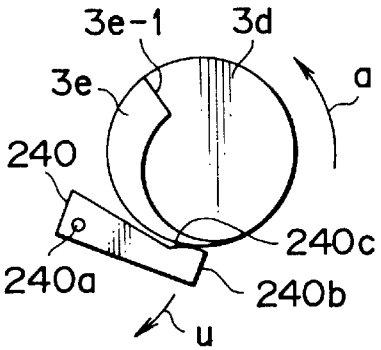
Figure 18C:
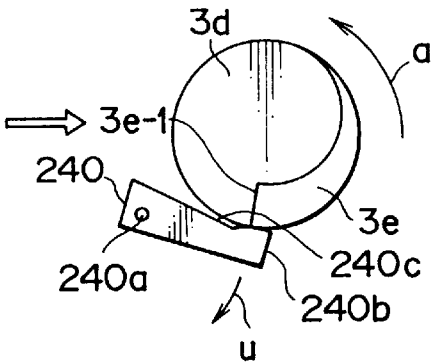
Figure 18D:
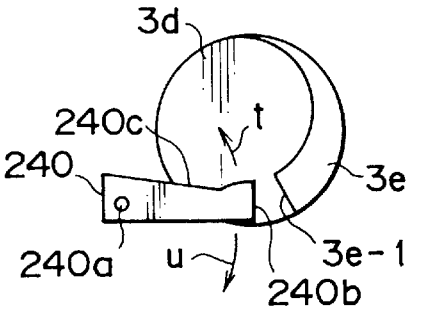
Figure 18E:
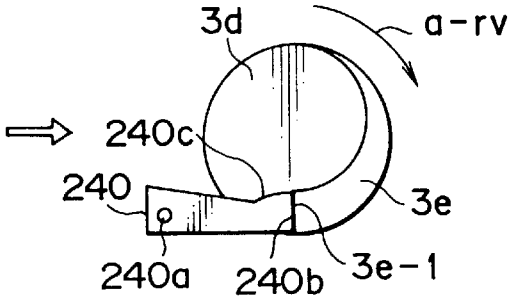

Further as shown in FIG. 18A or FIG. 18D, a corresponding stopper member 240 is provided rotatably round the rotation shaft 240*a* at a prescribed position in the bearing block 4*c*-2. The stopper member 240 is attached so as to be stopped at the position shown in FIG. 18A (or in FIG. 18D), to which stopper member 240 is pressed by a pressing force always in the direction of arrow t, for example, when a force is exerted against the pressing force to the stopper member 240 downward, then the stopper member 240 is moved rotationally in the direction of arrow u.

For example, as the rotation shaft 3*d* (winding spool 3) begins rotation in the proper winding direction namely in the direction of arrow a from the position shown in FIG. 18A, the peripheral portion of the stopper pawl 3*e* is brought into the contact with the claw stopper 240*c* of the stopper member 240 as shown FIG. 18B→FIG. 18C, and the stopper member 240 is pushed down in the direction of arrow u.

As described herein above, the cycle of FIG. 18A→FIG. 18B→FIG. 18C→FIG. 18A is repeated every one rotation of the rotation shaft 3*d*. In other words, the rotation shaft 3*d* is rotatable in the proper winding direction.

On the other hand, when the rotation shaft 3*d* is tried to be rotated from the position as shown in FIG. 18D (the same position shown in FIG. 18A) in the direction reverse to the proper winding direction shown with the arrow a-rv, a contact face 240*b* (the hatched portion shown in FIG. 17) of the stopper member 240 is brought into contact with a contact face 3*e*-1 (the hatched portion shown in FIG. 17) of the stopper pawl 3*e*, and the rotation shaft 3*d* is restricted so as not to rotate further.

As the result, the used ink ribbon 1 of the ink ribbon cartridge 5 cannot be rewound and the reuse is prevented.

In the above-mentioned embodiment, the case that the spool rotation direction restricting mechanism is provided on the winding spool 3 side is described, however, the rewinding of an ink ribbon 1 is also prevented by providing the spool rotation direction restricting mechanism on the supply spool 2 side instead of the winding spool 3 side. Otherwise, the spool rotation direction restricting mechanism may be provided on both supply spool 2 side and winding spool 3 side.

The spool rotation direction restricting mechanism shown in FIG. 17 and FIG. 18A to FIG. 18E are merely an example, a mechanism for restricting the rotation direction of at least one spool may be provided for achieving the purpose of the present invention.

A plurality of embodiments selected from the first to fifth embodiments described hereinbefore may be simultaneously employed differently from the above-mentioned case that any one of the embodiment selected from the first to fifth embodiments is employed.

Further, the above-mentioned embodiments involve the prevention of reuse of an ink ribbon used for, for example, a sublimation type thermal transfer color video printer, however, the present invention is by not means limited to the case, and the present invention is applied to any printer that uses an ink ribbon for printing.

As described hereinbefore, according to the present invention, because an ink ribbon which has been used already for printing is wound on a winding spool, which ink ribbon is damaged at least partially when it is wound, for example, even if a user wants to reuse the ink ribbon wound on the winding spool and rewinds the ink ribbon on the supply spool, the user cannot reuse the ink ribbon.

The image quality required essentially for a printer can be maintained by preventing the reuse of an ink ribbon.

Some users who want to reuse an ink ribbon often do not use specified printing paper recommended for, for example, obtaining good image quality and smooth paper feeding operation (paper supplying and paper discharging) in printing, therefore, the good image quality and proper printer operation are secured by preventing the reuse of an ink ribbon.

The mechanism for damaging an ink ribbon can be realized by the simple structure such as that a blade spring having a blade at the end is pressed against the winding shaft of a winding spool with a pressing force, or that a blade is attached on the winding shaft of a winding spool, or that a blade is provided at a prescribed position on a place other than on a winding spool to cut a certain portion of an ink ribbon to be wound on the winding spool.

A cover which covers at least the portion where an ink ribbon damaging mechanism is provided is attached so that a hand of a user cannot touch the blade of the ink ribbon damaging mechanism and the safety is secured in handling of the ink ribbon. For example, an ink ribbon feeding mechanism and a cover attaching mechanism are structured so that the ink ribbon feeding mechanism is damaged and does not operate properly when the cover is detached, thus such structure prevents a user from detaching the ink ribbon damaging mechanism itself to rewind the ink ribbon.

Other than the above-mentioned ink ribbon damaging mechanism, by applying a rotation direction restricting mechanism that at least one of a supply spool and winding spool is made rotatable in the rotation direction for printing use but not rotatable in the reverse rotation direction, the reuse of an ink ribbon is prevented.

What is claimed is:

1. An ink ribbon cartridge having an ink ribbon feeding mechanism comprising a supply spool, an ink ribbon wound on a winding spool, and an ink ribbon holder for supporting said ink ribbon, comprising:

ink ribbon damaging means; and rotation direction restricting means for allowing the rotation in proper direction for printing and for preventing the rotation in the direction reverse to the proper direction of at least one of said supply spool and said winding spool.

2. The ink ribbon cartridge as claimed in claim 1, wherein said ink ribbon damaging means has a blade spring at the end, and said blade is provided in contact with the winding shaft of said winding spool with a pressing force.

3. The ink ribbon cartridge as claimed in claim 1, wherein said ink ribbon damaging means has a blade attached to the winding shaft of said winding spool.

4. The ink ribbon cartridge as claimed in claim 3, wherein said blade is a ring blade having a desired diameter attached to the winding shaft of said winding spool so that said blade rotates round said winding shaft.

5. The ink ribbon cartridge as claimed in claim 1, wherein said ink ribbon damaging means has a blade located at a desired position so that said blade cuts a prescribed portion of said ink ribbon which is to be wound on said winding spool.

6. The ink ribbon cartridge as claimed in claim 1, wherein a cover means is additionally provided so as to cover at least the portion where said ink ribbon damaging means is provided.

7. The ink ribbon cartridge as claimed in claim 6, wherein said cover means is provided so as to prevent the operation of said ink ribbon feeding mechanism if said cover is removed.

8. A printer which uses an ink ribbon cartridge as claimed in claim 1.

* * * * *